US006692282B1

(12) United States Patent
Ye et al.

(10) Patent No.: US 6,692,282 B1
(45) Date of Patent: Feb. 17, 2004

(54) ZERO INSERTION FORCE SOCKET HAVING A COVER WITH BLIND CAVITIES

(75) Inventors: Pengfei Ye, Kunsan (CN); XuDong Sun, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/342,504

(22) Filed: Jan. 14, 2003

(30) Foreign Application Priority Data

Nov. 5, 2002 (TW) ..... 91217740 U

(51) Int. Cl.[7] ..... H01R 4/50
(52) U.S. Cl. ..... 439/342
(58) Field of Search ..... 439/342, 259

(56) References Cited

U.S. PATENT DOCUMENTS 6,254,415 B1 * 7/2001 Mizumura et al. ..... 439/342
6,296,506 B1 * 10/2001 Mizumura et al. ..... 439/342
6,338,640 B1 * 1/2002 Lin ..... 439/342
6,340,309 B1 * 1/2002 Lin et al. ..... 439/342
6,431,900 B1 * 8/2002 Yu ..... 439/342
6,450,827 B1 * 9/2002 Huang et al. ..... 439/342
6,464,525 B2 * 10/2002 Mizumura ..... 439/342
6,475,013 B1 * 11/2002 Pang et al. ..... 439/342
6,500,019 B1 * 12/2002 Tan ..... 439/342
6,508,659 B1 * 1/2003 Howell et al. ..... 439/342

* cited by examiner

*Primary Examiner*—Gary Paumen
*Assistant Examiner*—James R. Harvey
(74) *Attorney, Agent, or Firm*—Wei Te Chung

(57) ABSTRACT

A zero insertion force (ZIF) socket (1) is for electrically connecting a central processing unit (CPU) with a printed circuit board (PCB). The socket includes a dielectric base (10), a cover (11) slidably mounted on the base, an actuator (13) rotatably mounted between the base and the cover, and a multiplicity of terminals (12) received in the base for electrically connecting pins of the CPU with the PCB. The cover defines a multiplicity of holes (1110) therein, for receiving the pins of the CPU therethrough. A plurality of blind cavities (1111) is defined in a face of the cover that abuts the base. A cross section of each blind cavity is round. The cover is formed as a single piece by molding. The blind cavities can reduce deformation of the cover, thus enhancing uniform flatness thereof. This helps ensure accurate and reliable engagement between the base and the cover.

3 Claims, 4 Drawing Sheets

ZERO INSERTION FORCE SOCKET HAVING A COVER WITH BLIND CAVITIES

BACKGROUND OF THE INVENTION

1. Field of the Invention

The present invention relates to a zero insertion force (ZIF) socket for electrically connecting an electronic package such as a ball grid array (BGA) chip with a circuit substrate such as a printed circuit board (PCB), and particularly to a ZIF socket having a uniformly flat cover.

2. Description of the Prior Art

Electrical sockets are widely used in the connector industry for electrically connecting central processing units (CPUs) to printed circuit boards (PCBs) in personal computers (PCs). This is detailed in "Development of ZIF BGA SOCKET" (Connector Specifier, February 2002, pp. 18–20), and in U.S. Pat. Nos. 5,722,848 and 5,855,489. Referring to FIG. 4, the electrical socket 6 is designed for electrically interconnecting a CPU (not shown) with a PCB (not shown). The electrical socket 6 mainly comprises a dielectric base 60 having a multiplicity of terminals 63 received therein, a cover 61 slidably mounted on the base 60, and an actuation device 62 engaged with the base 60 and the cover 61. The CPU is attached and seated on the cover 61, with the pins of the CPU extending through the cover 61. By turning the actuation device 62, the cover 61 moves along the base 60 between an open position and a closed position. The CPU and the PCB are electrically connected in the closed position, and disconnected in the open position. The base 60 comprises a widened front portion 600 adjoining a main portion 601. The main portion 601 defines a multiplicity of terminal passageways 6010 in a generally rectangular array, the passageways 6010 interferentially receiving corresponding terminals 63. The cover 61 comprises a raised portion 610 at an end thereof, corresponding to the front portion 600 of the base 60. A multiplicity of holes 611 is defined in the cover 61, corresponding to the passageways 6010 of the base 60.

The cover 61 is integrally formed by injection molding. Forming the cover 61 to have the raised portion 610 is problematic. When flowing molten raw material is injected into a mold from a gate of the mold to form the cover 61, the flowing molten raw material is fed from a material source to a cavity in the mold through a runner system. Because the raised portion 610 is thicker than a main portion of the cover 61, the raised portion 610 of the cover 61 cools at a different rate from that of the main portion. Fibers gradually formed inside the material of the raised portion 610 and inside the material the main portion are arranged differently. This results in different and undesired internal stresses in these portions of the cover 61. These stresses usually cause the main portion and the raised portion to become deformed or deflected. The main portion of the cover 61 is not uniformly flat, and engagement between the base 10 and the cover 11 is incomplete and unreliable. Accordingly, mechanical and electrical connection between the CPU and the socket 6 may be impaired.

Therefore, a new electrical socket which overcomes the above-mentioned problems is desired.

SUMMARY OF THE INVENTION

An object of the present invention is to provide a ZIF socket having a cover configured to minimize the risk of distortion of the cover during molding thereof.

Another object of the present invention is to provide a ZIF socket having an inexpensive cover.

To achieve the above objects, a ZIF socket of the present invention is for electrically connecting a central processing unit (CPU) with a printed circuit board (PCB). The socket includes a dielectric base, a cover slidably mounted on the base, an actuator rotatably mounted between the base and the cover, and a multiplicity of terminals received in the base for electrically connecting pins of the CPU with the PCB. The cover comprises a main supporting portion, and a raised portion formed at one side of the supporting portion. The cover defines a multiplicity of holes therein, for receiving the pins of the CPU therethrough. A plurality of blind cavities is defined in a face of the cover that abuts the base. A cross section of each blind cavity is round.

The cover is formed as a single piece by molding. During cooling down of the duly molded cover, fibers gradually formed inside a material of the cover can be arranged randomly relative to a lengthwise axis of the cover. In addition, the material of the cover can be cooled down quickly without producing undesired stress inside the cover. This reduces the risk of deformation of the supporting portion of the cover. Tests have shown that the blind cavities can reduce deformation of the cover by up to 0.1 mm, thus significantly enhancing uniform flatness of the cover. This helps ensure that engagement between the base and the cover is accurate and reliable.

Other objects, advantages and novel features of the invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
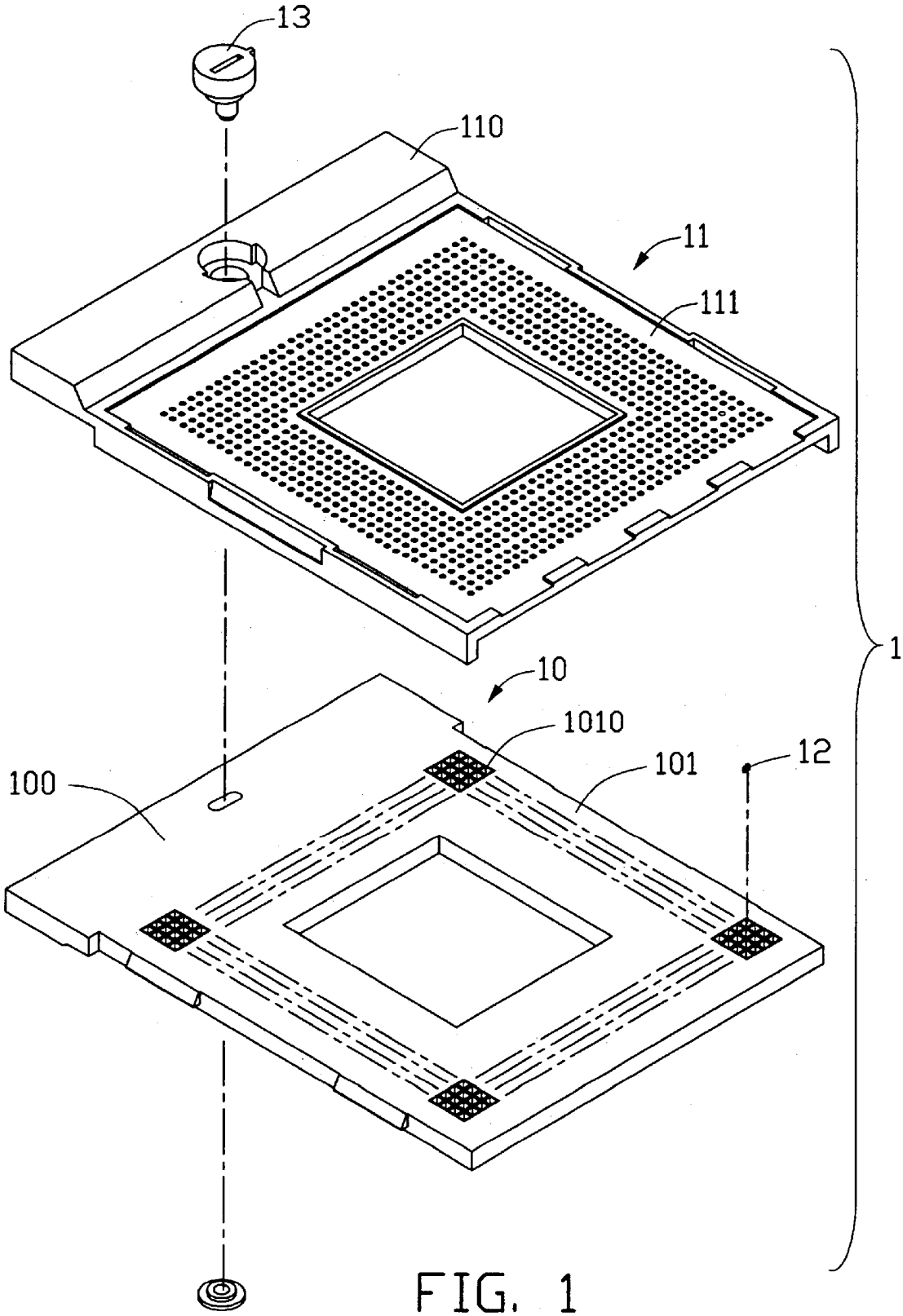
FIG. 1 is a simplified, exploded isometric view of a ZIF socket in accordance with a preferred embodiment of the present invention.
Figure 2:
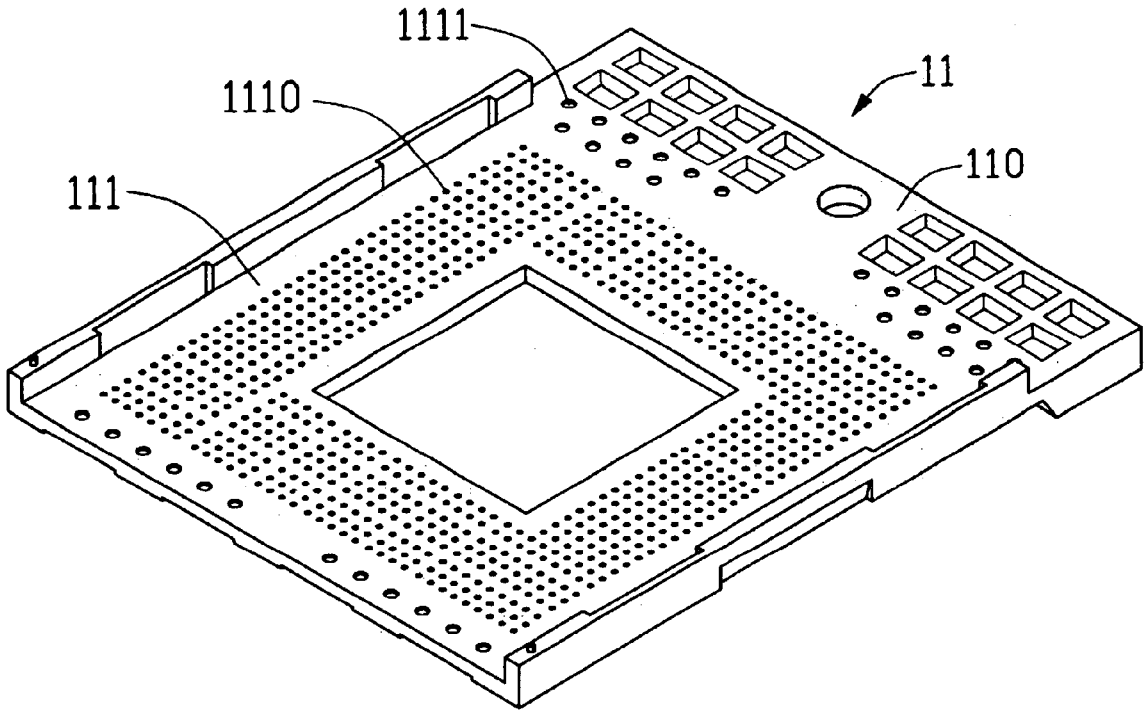
FIG. 2 is an isometric view of a cover of the ZIF socket of FIG. 1, but showing the cover inverted.
Figure 3:
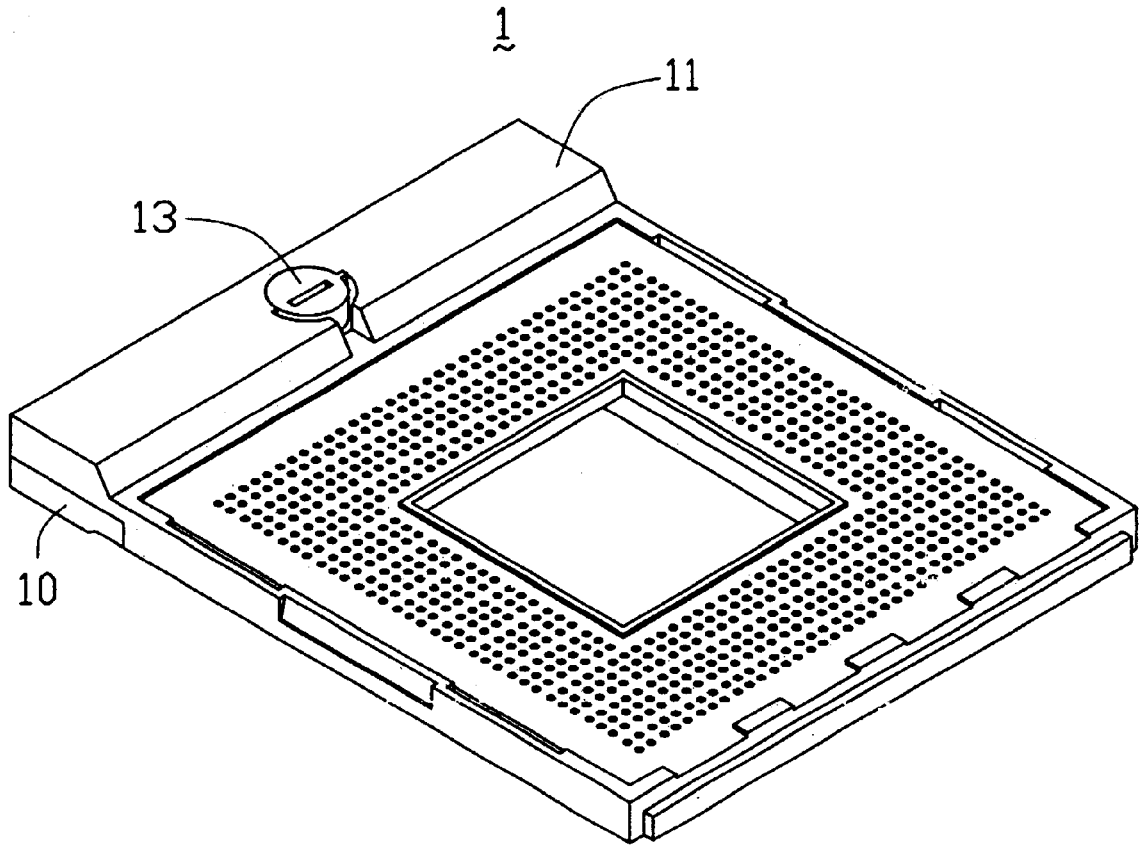
FIG. 3 is an assembled view of FIG. 1.
Figure 4:
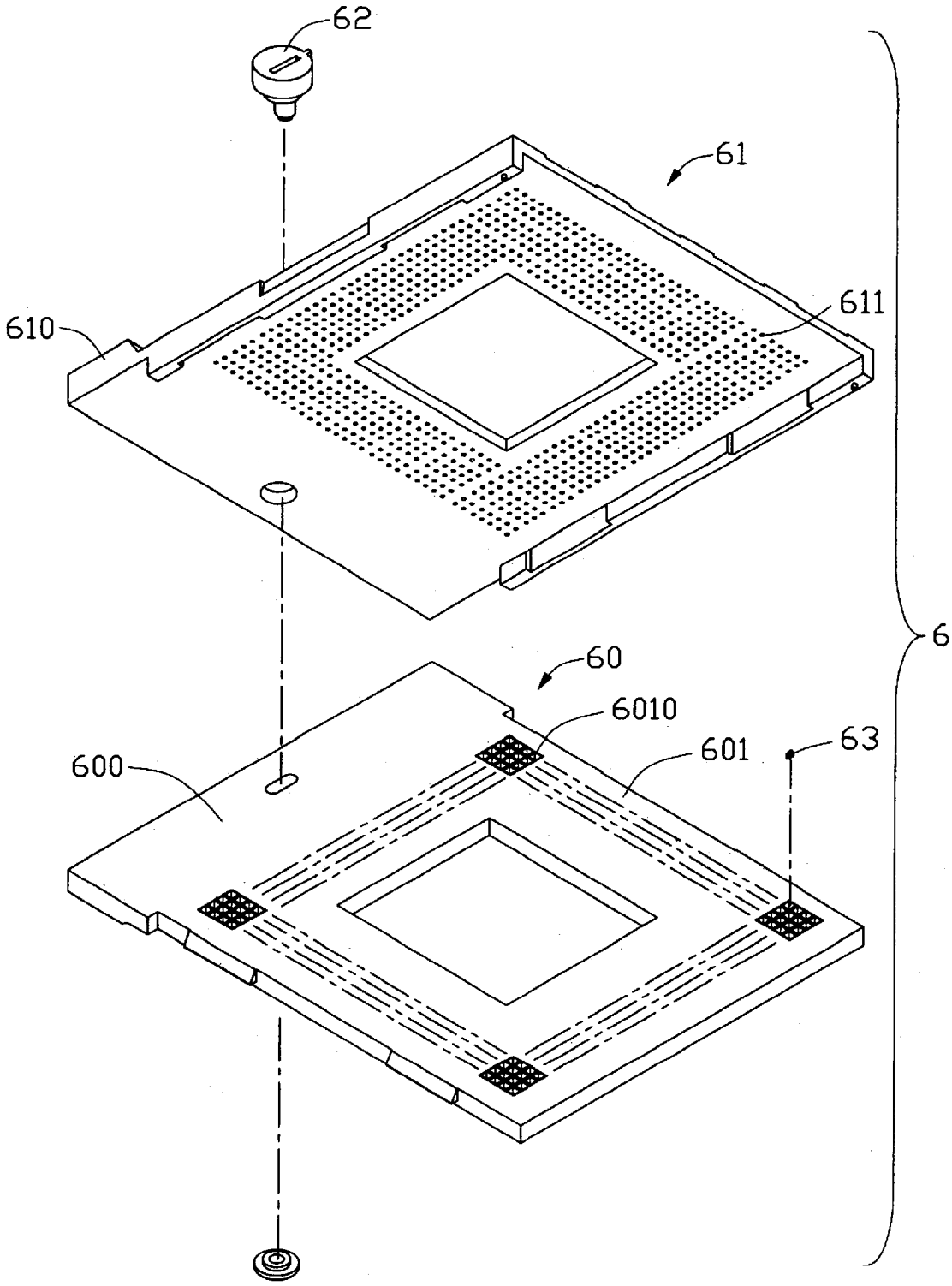
FIG. 4 (PRIOR ART)
FIG. 4 is a simplified, exploded isometric view of a conventional ZIF socket, showing a cover and a base thereof viewed from different aspects.

Referring to FIGS. 1, 2 and 3, a ZIF socket 1 in accordance with a preferred embodiment of the present invention comprises a dielectric base 10, a cover 11 slidably mounted on the base 10, an actuator 13 movably engaged between the base 10 and the cover 11, and a multiplicity of terminals 12 received in the base 10 for electrically connecting pins of a central processing unit (CPU) (not shown) with a printed circuit board (PCB, not shown).

The base 10 comprises a front portion 100 adjoining a main portion 101. A width of the front portion 100 is slightly greater than a corresponding width of the main portion 101. The main portion 101 defines a multiplicity of terminal passageways 1010 therein, the passageways 1010 receiving corresponding terminals 12.

The cover 11 is generally flat and rectangular, and is formed as a single piece by molding. The cover 11 comprises a main supporting portion 111 corresponding to the main portion 101 of the base 10, and a raised portion 110 formed at one side of the supporting portion 111 corresponding to the front portion 100 of the base 10. A thickness of the raised portion 110 is greater than a corresponding thickness of the supporting portion 111. The raised portion 110 defines a generally elliptical aperture in a middle thereof, for movably receiving the actuator 13 therethrough. The supporting portion 111 defines a multiplicity of holes 1110 therein, for receiving the pins of the CPU 2 therethrough. The holes 1110 of the cover 11 correspond to the passageways 1010 of the base 10. A plurality of blind cavities 1111 is defined in a face of the supporting portion 11I that abuts the base 10, both adjacent the raised portion 110 and at an end distal from the raised portion 110. A cross section of each blind cavity 1111 is round (see FIG. 2).

In the process of molding the cover 11, a plurality of mold pins that are disposed in cavities of the mold cooperatively form the blind cavities 1111. During cooling down of the duly molded cover 11, fibers gradually formed inside a material of the cover 11 are arranged substantially consistently. That is, fibers formed in the raised portion 110 are arranged similarly to fibers formed in a junction of the raised portion 110 and the supporting portion 111 in the vicinity of the blind cavities 1111 thereat. The fibers formed in said junction are arranged similarly to fibers formed in the supporting portion 111 in the vicinity of the holes 1110 thereat. The fibers formed in the supporting portion 111 in the vicinity of the holes 1110 thereat are arranged similarly to fibers formed at the end of the supporting portion 111 distal from the raised portion 110 in the vicinity of the blind cavities 1111 thereat. This results in uniform and gently graded internal stresses in the cover 61. This reduces the risk of deformation of the cover 11, particularly the supporting portion 111. Tests have shown that the blind cavities 1111 can reduce deformation of the cover 11 by up to 0.1 mm, thus significantly enhancing uniform flatness of the cover 11. This helps ensure that engagement between the base 10 and the cover 11 is accurate and reliable. In addition, the material of the cover 11 can be cooled down quickly without producing undesired stresses inside the cover 11. This allows faster manufacturing of the ZIF socket 1.

In assembly and use, the cover 11 is mounted on the base 10. The actuator 13 is rotatably received between the cover 11 and the base 10. By turning the actuator 13 with a tool such as a screwdriver, the cover 11 slides along the base 10 between an open position and a closed position. The CPU (not shown) is seated on the socket 1, and the pins of the CPU are received through the holes 1110 of the cover 11 and in the corresponding passageways 1010 of the base 10. When the actuator 13 is rotated to drive the cover 11 to slide to the closed position, the pins of the CPU are pushed by the cover 11 to mechanically and electrically engage with the terminals 12 of the base 10. When the actuator 13 is rotated to drive the cover 11 to slide to the open position, the pins of the CPU are pushed by the cover 11 to mechanically and electrically disengage from the terminals 12 of the base 10.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting an electronic package with a circuit substrate, the electrical connector comprising:

a dielectric base defining a plurality of passageways adapted to receive a plurality of conductive terminals therein respectively; and a cover slidably mounted on the base and adapted to receive and push a plurality of pins of the electronic package;

wherein the cover defines a plurality of blind cavities in a face that abuts the base to prevent the cover from deforming during molding thereof;

wherein a cross section of each of the blind cavities is round;

further comprising an actuator movably mounted between the cover and the base;

wherein the cover slides along the base between an open position and a closed position, and in the closed position the pins of the electronic package mechanically and electrically engage with terminals of the base, wherein said cover includes a raised portion where an actuator is located, and said blind cavities are located between said raised portion and said passageways.

2. An electrical assembly comprising:

a socket comprising a dielectric base defining a plurality of passageways receiving a plurality of terminals therein, a cover slidably mounted on the base and defining a plurality of holes in general alignment with the passageways respectively, the cover defining a plurality of blind cavities adjacent the holes; and an electronic package placed on the cover, the electronic package having a plurality of pins received in corresponding passageways of the base via corresponding holes of the cover; wherein each of the blind cavities is formed in a face of the cover that abuts the base to prevent the cover from deforming during molding thereof whereby the cover is uniformly flat;

wherein a cross section of each of the blind cavities is round;

wherein the socket further comprises an actuator movably mounted between the cover and the base;

wherein the cover comprises a raised portion at one end thereof;

wherein the base comprises an end portion corresponding to the raised portion of the cover.

3. An electrical connector assembly, comprising:

an electrical socket including a base defining a plurality of passageways therein;

a cover slidably mounted on the base, and defining a mating face thereon and a plurality of holes extending in a first direction;

a plurality of terminals received within corresponding passageways, respectively; and an electronic component located above said mating face and including a plurality of conductive pins extending therefrom in said first direction and into the corresponding passageways for engagement with corresponding terminals; wherein a plurality of blind cavities is defined in the cover adjacent the holes to prevent the cover from deforming during molding thereof and ensure reliable engagement between the cover and the base;

wherein said blind cavities are defined at the mating face, wherein a cross section of each of the blind cavities is round, wherein said electronic component is a central processing unit.

* * * * *